US012392132B2

(12) United States Patent
Förg et al.

(10) Patent No.: US 12,392,132 B2
(45) Date of Patent: Aug. 19, 2025

(54) SEALING DEVICE FOR THE EDGE JOINT OF DRYWALL, DRYWALL, AS WELL AS A METHOD FOR PRODUCING DRYWALL

(71) Applicant: Hilti Aktiengesellschaft, Schaan (LI)

(72) Inventors: Christian Förg, Buchloe (DE); Manfred Klein, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 112 days.

(21) Appl. No.: 18/041,664

(22) PCT Filed: Aug. 20, 2021

(86) PCT No.: PCT/EP2021/073161
§ 371 (c)(1),
(2) Date: Feb. 14, 2023

(87) PCT Pub. No.: WO2022/043219
PCT Pub. Date: Mar. 3, 2022

(65) Prior Publication Data

US 2024/0263440 A1 Aug. 8, 2024

(30) Foreign Application Priority Data

Aug. 24, 2020 (EP) ..... 20192386

(51) Int. Cl.
*E04B 1/68* (2006.01)

(52) U.S. Cl.
CPC ..... *E04B 1/6813* (2013.01)

(58) Field of Classification Search
CPC ..... E04B 1/6813; E04B 1/948; E04B 2/7411; E04B 2/7457
See application file for complete search history.

(56) References Cited

U.S. PATENT DOCUMENTS 8,640,415 B2 2/2014 Pilz et al.
8,793,947 B2 8/2014 Pilz et al.
(Continued)

FOREIGN PATENT DOCUMENTS

DE 29505833 U1 6/1995
EP 3584381 12/2019

OTHER PUBLICATIONS

International Search Report dated Nov. 5, 2021, in PCT/EP2021/073161, with English translation, 5 pages.
(Continued)

*Primary Examiner* — Babajide A Demuren
(74) *Attorney, Agent, or Firm* — Grüneberg and Myers PLLC

(57) ABSTRACT

A sealing device can be used for sealing an edge joint between cladding of drywall and an adjacent floor, wall, or ceiling. The sealing device contains a one-piece sealing profile, containing a bearing web which is opposite a circumferential side of the cladding, a fastening web running parallel to the bearing web for fastening the sealing profile to a holding rail of the drywall, and an outer supporting web, viewed in cross section, covering the edge joint at least in portions. The outer supporting web is adjacent to and supports the bearing web, and via which the bearing web is connected to the fastening web. Furthermore, drywall can contain the sealing device of this type, and a method can be used for producing drywall of this type.

14 Claims, 2 Drawing Sheets

(56) References Cited

U.S. PATENT DOCUMENTS

| | | | | |
|---|---|---|---|---|
| 9,290,932 | B2 | 3/2016 | Pilz et al. | |
| 9,683,364 | B2 | 6/2017 | Pilz et al. | |
| 10,184,246 | B2 | 1/2019 | Pilz et al. | |
| 10,487,497 | B1 | 11/2019 | Aitken | |
| 11,060,283 | B2 | 7/2021 | Pilz et al. | |
| 11,905,705 | B2 | 2/2024 | Pilz et al. | |
| 2015/0135631 | A1* | 5/2015 | Foerg | E04B 2/7411 428/68 |
| 2016/0017598 | A1* | 1/2016 | Klein | E04B 2/7411 52/232 |
| 2016/0017599 | A1* | 1/2016 | Klein | E04B 2/7411 52/717.03 |
| 2017/0175386 | A1 | 6/2017 | Pilz | |
| 2023/0304280 | A1* | 9/2023 | Förg | E04B 2/7411 |
| 2023/0323656 | A1* | 10/2023 | Förg | E04B 1/6813 52/396.06 |
| 2024/0263444 | A1 | 8/2024 | Pilz et al. | |

OTHER PUBLICATIONS

Written Opinion dated Nov. 5, 2021, in PCT/EP2021/073161, with English translation, 10 pages.

Hilti, "Bottom Track Seal CFS-BTS", Product Information, CFS-BTS 5/8" and CFS-BTS 1-1/4", Sep. 2023, 1 page.

Cemco®, "Hotrod® BW Compressible Firestop", Product Description, Feb. 11, 2025, 2 pages.

Cemco®, "Smoke & Sound Stop Blue (SSSB)", Product Description, Feb. 11, 2025, 2 pages.

"XHBN—Joint Systems: XHBN7—Joint Systems Certified for Canada", System No. BW-S-0024, UL Product IQ®, Sep. 6, 2024, 4 pages.

Blaze Foam, Intumescent compressible Firestop Foam, for Head of Wall Applications—Dynamic & Static, Blazing Fast Firestop Installation, RectorSeal, 2018, 2 pages.

Förg et al., U.S. Appl. No. 18/041,675, filed Feb. 14, 2023.

Förg et al., U.S. Appl. No. 18/042,467, filed Feb. 22, 2023.

Förg et al., U.S. Appl. No. 18/042,480, filed Feb. 22, 2023.

Förg et al., U.S. Appl. No. 18/042,498, filed Feb. 22, 2023.

Förg et al., U.S. Appl. No. 18/042,634, filed Feb. 23, 2023.

Förg et al., U.S. Appl. No. 18/042,767, filed Feb. 23, 2023.

U.S. Appl. No. 18/042,498, filed Feb. 22, 2013, Förg et al.

U.S. Appl. No. 18/041,675, filed Feb. 14, 2023, Förg et al.

U.S. Appl. No. 18/042,634, filed Feb. 23, 2023, Förg et al.

U.S. Appl. No. 18/042,767, filed Feb. 23, 2023, Förg et al.

U.S. Appl. No. 18/042,480, filed Feb. 22, 2023, Förg et al.

U.S. Appl. No. 18/042,467, filed Feb. 22, 2023, Förg et al.

* cited by examiner

SEALING DEVICE FOR THE EDGE JOINT OF DRYWALL, DRYWALL, AS WELL AS A METHOD FOR PRODUCING DRYWALL

CROSS-REFERENCE TO RELATED APPLICATIONS

This application is the National Stage entry under § 371 of International Application No. PCT/EP2021/073161, filed on Aug. 20, 2021, and which claims the benefit of priority to European Application No. 20192386.9, filed on Aug. 24, 2020. The content of each of these applications is hereby incorporated by reference in its entirety.

BACKGROUND OF THE INVENTION

Field of the Invention

The invention relates to a sealing device for sealing an edge joint between cladding of drywall and an adjacent floor, wall, or ceiling. The invention also relates to drywall comprising a holding rail, cladding, and a sealing device of this type. The invention also relates to a method for producing drywall comprising a sealing device of this type.

Description of Related Art

Edge joints, in particular floor joints, are designed to provide sound decoupling of the drywall from adjacent walls, ceilings, or floors, in particular floorings.

The wall surfaces of the drywall are formed by cladding parts such as gypsum boards, which often have to be protected from moisture. The edge joints therefore also form a barrier that protects the cladding parts against rising moisture, for example in the event of a pipe burst.

The edge joints are usually sprayed with a sealing compound in order to provide a sound and fire protection function and to seal the joint against air and odors.

Sealing compounds have the disadvantage that the application is time-consuming and not very ergonomic. Furthermore, sealing compounds can usually only be used reliably at temperatures of at least 5° C. and the substrate must be dry and dust-free. The inspection is not easy either, since, for example, the installation depth cannot be checked non-destructively.

SUMMARY OF THE INVENTION

The object of the invention is to provide a sealing device for an edge joint of drywall, which ensures easy assembly of the sealing device and effective sealing of the edge joint. Furthermore, drywall improved in these aspects and a production method are to be specified.

To achieve this object, a sealing device for sealing an edge joint between cladding of drywall and an adjacent floor, wall, or ceiling is provided. The sealing device comprises a one-piece sealing profile having a bearing web, which lies opposite a circumferential side of the cladding, a fastening web running parallel to the bearing web for fastening the sealing profile to a holding rail of the drywall, and an outer supporting web, viewed in cross section, covering the edge joint at least in portions, preferably completely, which supporting web is adjacent to and supports the bearing web and via which the bearing web is connected to the fastening web.

It was recognized that a sealing device of this type can be installed with little effort. The bearing web ensures that the sealing device is aligned in a defined manner on the cladding, while the sealing profile seals and closes an edge joint with a specified width. The cladding is thus effectively protected from moisture from an adjacent floor, wall, or ceiling.

In one embodiment, the fastening web, viewed in cross section, runs on the side remote from the outer supporting web further outward than the bearing web and forms the portion of the sealing profile that extends furthest outward on this side. The fastening web thus extends on the inner side, i.e. facing the holding rail, beyond the edge joint. As a result, the fastening web can be inserted into a gap between the holding rail and the adjacent floor, wall, or ceiling in order to fasten the sealing device.

DETAILED DESCRIPTION OF THE INVENTION

Figure 1:
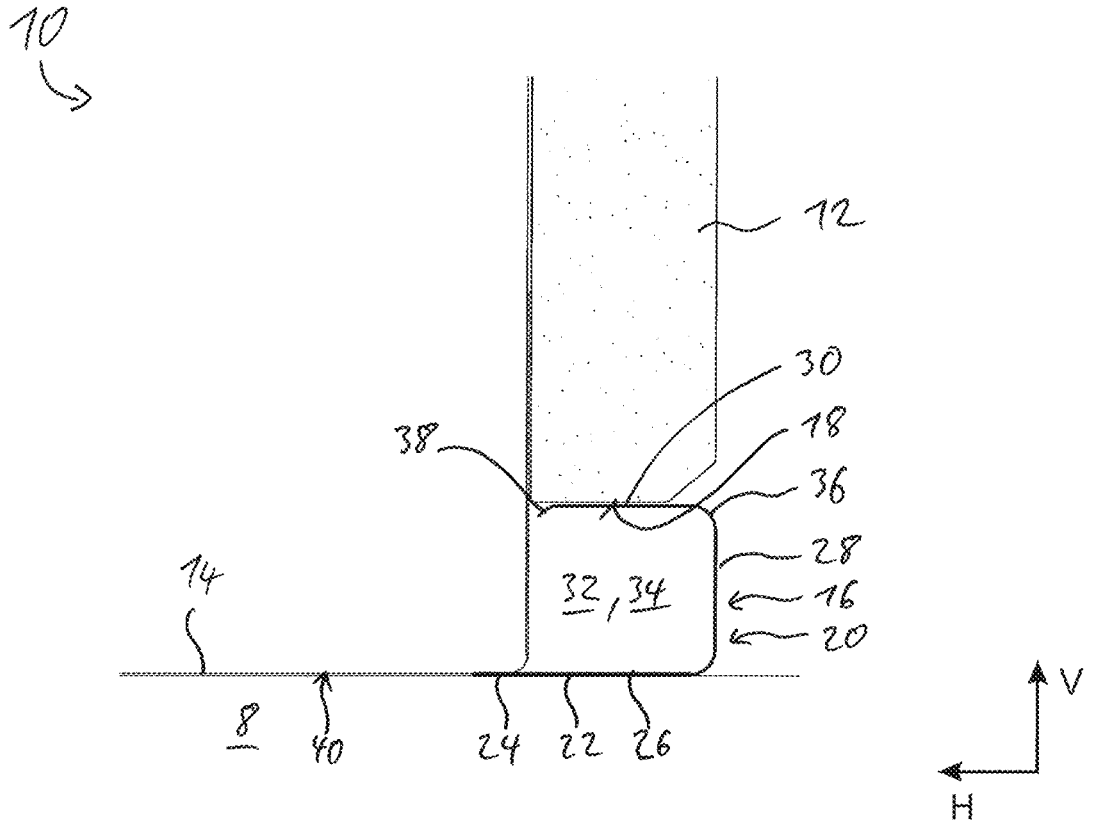
FIG. 1 is a schematic sectional view of drywall according to the invention with a sealing device according to the invention.

Additionally or alternatively, the sealing profile can have an inner supporting web which extends perpendicular to the bearing web up to the fastening web. As a result, the sealing profile in the form of the inner supporting web and of the outer supporting web has two supporting webs which carry the load of the cladding during the assembly of the drywall. Thus, the sealing device has a higher stability and in this way ensures a constant joint width.

The outer and inner supporting webs run in particular parallel to one another.

Furthermore, it can be provided that the outer and inner supporting webs extend from opposite ends of the bearing web, viewed in cross section, as a result of which the stability of the sealing profile is further increased.

In a further embodiment, the outer supporting web runs perpendicular to the bearing web and thus forms a room-side closure, which extends parallel to the wall surface of the cladding or the drywall.

The sealing profile can have a connecting web via which the fastening web is connected to the outer supporting web. As a result, the sealing profile has a particularly high strength in the direction of the joint depth.

In this case, the connecting web, viewed in cross section, can extend obliquely away from the fastening web from a plane formed by the fastening web up to the outer supporting web. Furthermore, a sealing strip is arranged on the outside of the connecting web in order to close the gap between the plane and the connecting web. The sealing strip, together with the sealing profile, forms two sealing planes functionally connected in series in the direction of the joint depth, as a result of which the sealing device provides a particularly effective seal.

According to one embodiment, a functional element made of an intumescent and/or sound-absorbing material is arranged in the interior of the sealing profile and is fastened to the sealing profile. In the scope of the invention, the interior of the sealing profile denotes a cavity that is at least in portions enclosed by the sealing profile. As a result of the functional element, the sealing device has correspondingly improved fire protection properties and/or provides more effective sound absorption. Since the functional element is arranged in the interior of the sealing profile, it is received in a particularly protected manner, so that damage to the functional element is avoided, especially in logistics or during assembly.

It can be provided that the sealing profile is covered on the outside at least on the bearing web or completely with a resilient sealing layer. In this way, the cladding rests against the bearing web via the resilient sealing layer, as a result of which the gap between the cladding and the sealing profile is particularly effectively sealed. Furthermore, structure-borne noise decoupling can be provided by means of the resilient sealing layer.

According to a further embodiment, the sealing profile is formed from a metal or a plastics material and can thus be produced in a particularly stable and cost-effective manner.

Furthermore, the sealing profile can preferably be an extrusion profile, as a result of which the sealing device can be produced with little effort and in any length.

According to the invention, drywall comprising a holding rail, cladding, and a sealing device according to the invention with the aforementioned advantages is also provided to achieve the above-mentioned object. The cladding presses with its circumferential side against the bearing web and the fastening web is held in a gap between the holding rail and the adjacent floor, wall, or ceiling. In this way, the edge joint, which is formed between the cladding and the adjacent floor, wall, or ceiling, can be sealed reliably and with little effort by the sealing device. In particular, the sealing device can be fastened without fastening means.

In one embodiment, the drywall is drywall having double-layer cladding and has a second sealing device according to the invention. The cladding is double-layer cladding with a first cladding part and a second cladding part, the first cladding part pressing with its circumferential side against the bearing web of the first sealing profile and the second cladding part pressing with its circumferential side against the bearing web of the second sealing profile. The fastening web of the second sealing profile is arranged in a gap between the first sealing profile and the adjacent floor, wall, or ceiling. The sealing profiles are arranged in series in the direction of the joint depth and thus provide a particularly effective seal for the edge joint, which edge joint is formed by the double-layer cladding and the adjacent floor, wall, or ceiling.

In a further embodiment, the drywall has at least one sealing device according to the invention, which has a connecting web with an outer sealing strip. Between the wall, floor, or ceiling and the opposite, inclined fastening web, the sealing strip is arranged on the outside of the connecting web in such a way that the gap between the wall, floor, or ceiling and the opposite, inclined fastening web is closed and thus sealed.

According to the invention, to solve the above-mentioned object, a method for producing drywall having a holding rail, cladding, and a sealing device according to the invention is provided, comprising the following steps:

attaching the holding rail to the wall, floor, and/or ceiling.

driving the fastening web into a gap between the holding rail and the adjacent floor, wall, or ceiling, so that the fastening web is clamped between the holding rail and the adjacent floor, wall, or ceiling, and fastening the cladding to a stand construction of the drywall, wherein the circumferential side of the cladding rests against the bearing web.

Figure 2:
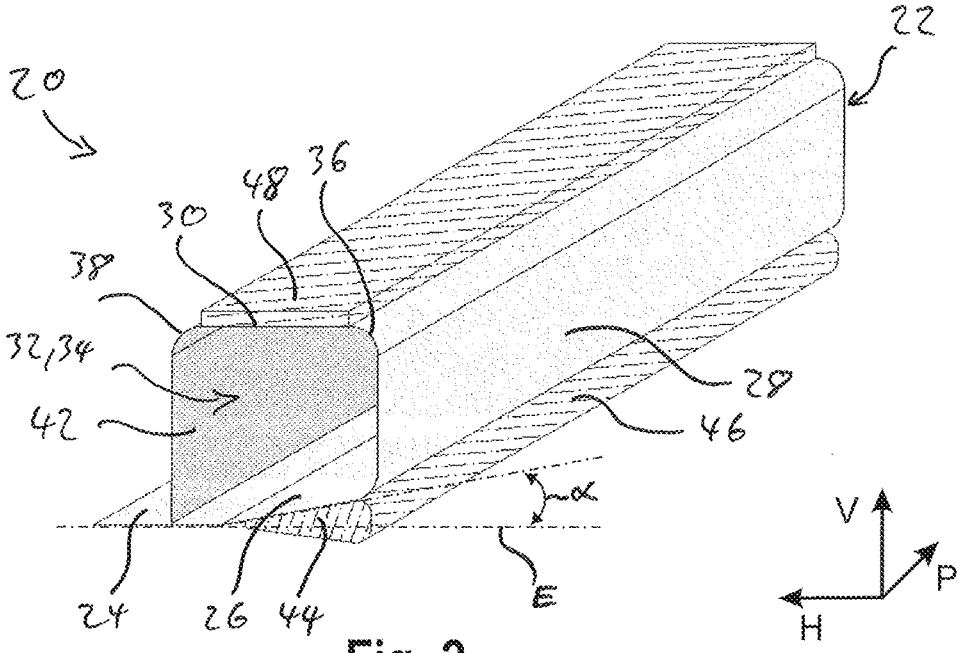
FIG. 2 is a perspective view of a sealing device according to the invention in accordance with a further embodiment.
Figure 3:
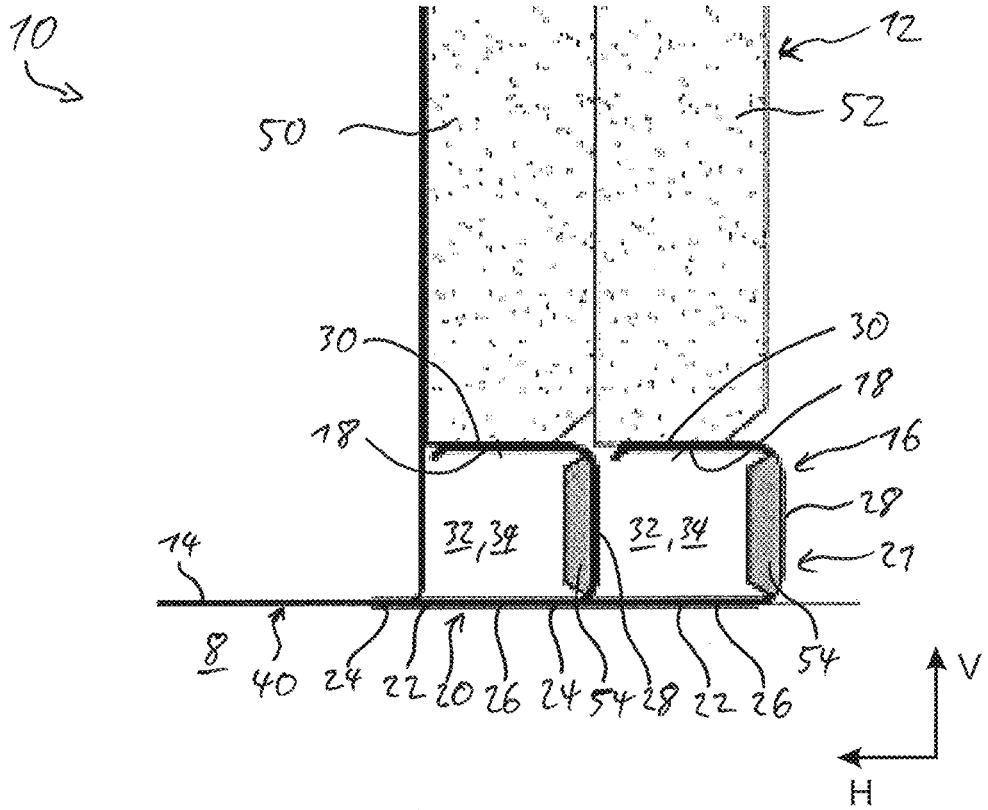
FIG. 3 is a schematic sectional view of drywall according to the invention with a wall surface having double-layer cladding and a sealing device according to the invention in accordance with a further embodiment.
Figure 4:
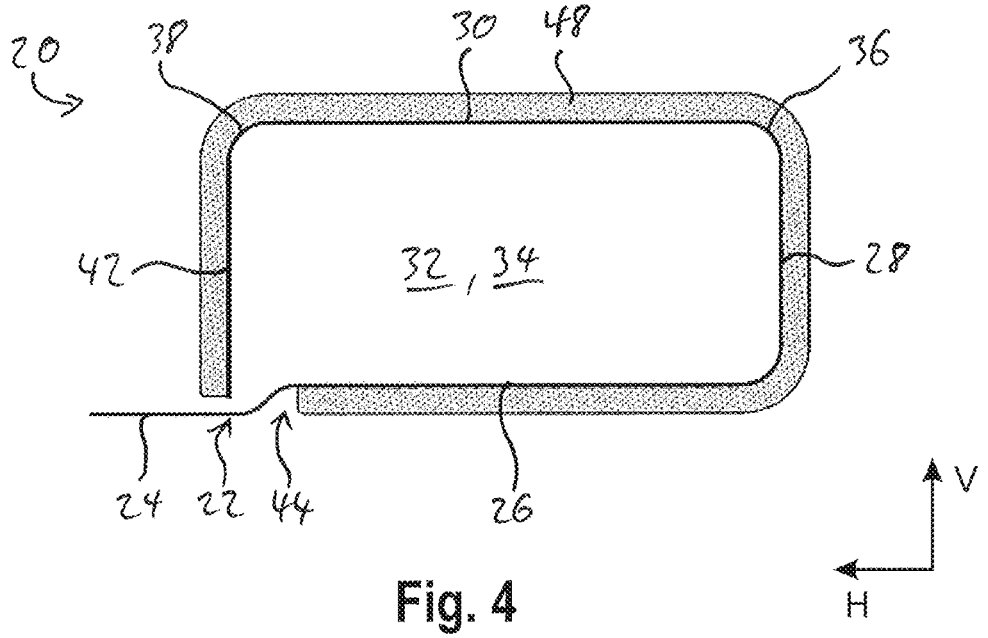
FIG. 4 is a schematic sectional view of a sealing device according to the invention in accordance with a further embodiment.

Further advantages and features emerge from the following description and from the accompanying drawings. In the drawings:

FIG. 1 is a schematic sectional view of drywall according to the invention with a sealing device according to the invention, FIG. 2 is a perspective view of a sealing device according to the invention in accordance with a further embodiment, FIG. 3 is a schematic sectional view of drywall according to the invention with a wall surface having double-layer cladding and a sealing device according to the invention in accordance with a further embodiment, and FIG. 4 is a schematic sectional view of a sealing device according to the invention in accordance with a further embodiment.

FIG. 1 is a cross section of drywall 10 with cladding 12 (gypsum wall) and a holding rail 14, which is part of a stand construction of the drywall 10.

In the present case, the holding rail 14 is a U-shaped floor profile (only half of which is shown in FIG. 1), which is firmly anchored on the floor 8 extending in the horizontal direction H, for example by means of dowels.

The cladding 12 is attached to the stand construction at a distance from the floor 8, as a result of which an edge joint 16 in the form of a floor joint is formed in the vertical direction V between a circumferential side 18 of the cladding 12 and the floor 8.

In order to seal the edge joint 16, the drywall 10 also has a sealing device 20, the structure of which is described below. The sealing device 20 is also suitable for sealing the edge joint 16 between the drywall 10 and the ceiling and/or wall.

The sealing device 20 comprises a one-piece sealing profile 22 comprising a fastening web 24, a connecting web 26, an outer supporting web 28, and a bearing web 30, which together form a C-shaped base body which encloses a cavity 32 in the interior 34.

At the outer end 36 or edge of the bearing web 30, i.e. the end 36 that faces away from the holding rail 14, the outer supporting web 28 extends perpendicularly away from the bearing web 30 and is connected via the connecting web 26 to the fastening web 24, which fastening web extends parallel to the bearing web 30 beyond the inner end 38 of the bearing web 30 in the horizontal direction H.

The sealing profile 22 is, for example, an extruded profile made of an impact-resistant plastics material such as polyamide, PVC, or ABS.

Alternatively, the sealing profile 22 can consist of metal, in particular of a reshaped sheet metal.

When assembling the drywall 10, the holding rail 14 is first anchored to the floor 8 and the stand construction of the drywall 10 is erected.

Subsequently, the sealing device 20 comprising the fastening web 24 adjacent to the floor 8 is placed on the holding rail 14, so that the fastening web 24 rests against the gap 40 that is formed between the holding rail 14 and the base 8.

The sealing device 20 is then driven into the gap 40 in the horizontal direction H, for example with a hammer, until the fastening web 24 is received in a clamped manner between the holding rail 14 and the floor 8 and is thus securely fastened.

In a subsequent step, the cladding 12 is attached to the stand construction.

In this case, the cladding 12 is set up with its circumferential side 18 on the bearing web 30, so that the sealing device 20 is pressed against the floor 8, and then fastened to the stand construction of the drywall 10.

By placing the cladding 12 on the bearing web 30 during assembly, it is ensured that the edge joint 16 has a defined width, while the weight of the cladding 12 ensures that the sealing device 20 rests sealingly against the floor 8.

The sealing device 20 has a size that ensures that the sealing device 20 is received in a clamped manner in the edge joint 16 between the circumferential side 18 of the cladding 12 and the floor 8 and thus reliably seals the edge joint 16. The outer supporting web 28 supports the bearing web 30 in the vertical direction V.

In all embodiments, the bearing web 30 is arranged opposite the circumferential side 18 of the cladding 12 and forms a support for this.

In principle, the sealing device 20 can be formed to seal any edge joint 16 between a circumferential side 18 of the cladding 12 and an adjacent floor 8, wall, or ceiling.

A sealing device according to a further embodiment will now be described with reference to FIG. 2. The same reference signs are used for the components which are known from the above embodiment and in this respect reference is made to the preceding explanations. The direction of extension P denotes the direction in which the profile extends in its longitudinal direction.

In contrast to the sealing device 20 shown in FIG. 1, the sealing profile 22 has, in addition to the outer supporting web 28, an inner supporting web 42, which extends from the internal end 38 of the bearing web 30 parallel to the outer supporting web 28 up to the fastening web 24.

Furthermore, the outer supporting web 28 is shorter than in the embodiment shown in FIG. 1 and therefore does not extend over the entire joint width. The connecting web 26, viewed in cross section, is inclined towards the bearing web 30 at an angle $\alpha$ with respect to a plane E which runs parallel to the fastening web 24. Hereby, for example a wedge-shaped gap 44 is formed between the connecting web 26 and the plane E.

The sealing device 20 has a sealing strip 46 which is attached in the gap 44 on the outer side of the connecting web 26.

The sealing strip 46 extends in the vertical direction V beyond the plane E.

In the installed state of the sealing device 20, the sealing strip 46 is compressed between the connecting web 26 and the adjacent floor 8, wall, or ceiling and thus ensures effective sealing of the gap 44 and thus the edge joint 16.

In order to ensure that the circumferential side 18 of the cladding 12 rests sealingly against the sealing device 20, the sealing device 20 also has a resilient sealing layer 48 which is attached to the outer side of the bearing web 30 on the sealing profile 22. In the present case, this is a sealing strip.

Drywall having a sealing device according to a further embodiment will now be described with reference to FIG. 3. The same reference signs are used for the components which are known from the above embodiments and in this respect reference is made to the preceding explanations.

The drywall 10 has double-layer cladding 12 with an inner cladding part 50 adjacent to the stand construction and an outer cladding part 52 adjacent to the inner cladding part 50, which cladding part forms the outer side of the drywall 10.

The edge joint 16 is sealed in this case by two identical sealing devices 20, 21 which are arranged in series in the horizontal direction H. In this case, the outer sealing device 21 is fastened to the internal sealing device 20 in that the fastening web 24 of the outer sealing device 21 is clamped in a gap which is formed by the connecting portion 26 of the inner sealing device 20 and the adjacent floor 8.

The inner sealing device 20 rests under pretension with the bearing web 30 against the circumferential side 18 of the inner cladding part 50, while the outer sealing device 21 rests under pretension with the bearing web 30 against the circumferential side 18 of the outer cladding part 52.

In contrast to the sealing device 20, which is shown in FIG. 1, each of the sealing devices 20, 21 has a functional element 54 which is fastened in the interior 34 of the sealing profile 22 on the outer supporting web 28.

The material from which the functional element 54 is made has intumescent, thermally insulating, water-repellent, sealing, and/or sound-absorbing properties and is, for example, a foam or mineral wool.

In principle, the functional element 54 can be fastened to any portion of the sealing profile 22. Additionally or alternatively, the functional element 54 can fill the entire cavity 32.

A sealing device according to a further embodiment will now be described with reference to FIG. 4. The same reference signs are used for the components which are known from the above embodiments and in this respect reference is made to the preceding explanations.

In this case, the sealing device 20 has a resilient sealing layer 48 which extends over the entire outer side of the inner supporting web 42, the bearing web 30, the outer supporting web 28, and the connecting web 26 and thus covers the sealing profile 22 on all sides, viewed in cross section, at least in portions.

This embodiment can be produced particularly inexpensively in that the sealing profile 22 is formed from a sheet metal which is first coated with the resilient sealing layer 48 and then reshaped.

Of course, in an alternative embodiment, the resilient sealing layer 48 can extend over the entire outer side of the sealing profile 22.

In this way, there is a sealing device 20 provided for an edge joint 16 of drywall 10, which ensures easy assembly in all embodiments.

In particular, the design of the sealing device 20 ensures that it can be fastened quickly and reliably without fastening means such as bolts or nails.

Furthermore, the sealing device 20 ensures that the edge joint 16 is effectively sealed with respect to air and sound.

The sealing device 20 turns the drywall 10 into a fire-safe construction, by means of which smoke, temperature, and fire can be prevented from spreading over to the side of the drywall 10 that faces away from the fire.

The dimensions of the sealing profile 22 ensure a defined joint width and also protect the cladding 12 against moisture in or on the floor 8, in particular during the construction phase.

Furthermore, the sealing device 20 is a factory-made application solution with constant properties, which makes the sealing of edge joints with a consistently high quality easier.

The invention is not limited to the embodiments shown. In particular, individual features of one embodiment can be combined in any way with features of other embodiments, independently of the other features of the corresponding embodiments.

For example, each of the sealing devices 20 can have a sealing strip 46, a resilient sealing layer 48, and/or a functional element 54.

The invention claimed is:

1. A sealing device for sealing an edge joint between cladding of drywall and an adjacent floor, wall, or ceiling, the sealing device comprising:

a one-piece sealing profile comprising a bearing web which is opposite a circumferential side of the cladding, a fastening web running parallel to the bearing web that fastens the sealing profile to a holding rail of the drywall, and an outer supporting web, viewed in cross section, covering the edge joint at least in portions, wherein the outer supporting web is adjacent to and supports the bearing web and via which the bearing web is connected to the fastening web, wherein the sealing profile has a connecting web via which the fastening web is connected to the outer supporting web.

2. The sealing device according to claim 1, wherein the fastening web, viewed in cross section, runs on a side remote from the outer supporting web further outward than the bearing web and forms a portion of the sealing profile that extends furthest outward on the side remote from the outer supporting web.

3. The sealing device according to claim 1, wherein the sealing profile has an inner supporting web which extends perpendicular to the bearing web up to the fastening web.

4. The sealing device according to claim 3, wherein the outer supporting web and the inner supporting web extend from opposite ends of the bearing web, viewed in cross section.

5. The sealing device according to claim 1, wherein the outer supporting web runs perpendicular to the bearing web.

6. The sealing device according to claim 1, wherein the connecting web, viewed in cross section, extends obliquely away from the fastening web from a plane formed by the fastening web up to the outer supporting web, wherein a sealing strip is arranged on an outside of the connecting web in order to close a gap between the plane and the connecting web.

7. The sealing device according to claim 1, wherein a functional element made of an intumescent and/or sound-absorbing material is arranged in an interior of the sealing profile and is fastened to the sealing profile.

8. The sealing device according to claim 1, wherein the sealing profile is covered on an outside, at least on the bearing web or completely, with a resilient sealing layer.

9. The sealing device according to claim 1, wherein the sealing profile is formed from a metal or a plastic material.

10. The sealing device according to claim 1, wherein the sealing profile is an extrusion profile.

11. Drywall, comprising:

a holding rail, cladding, and the sealing device according to claim 1, wherein the cladding presses with the circumferential side against the bearing web and the fastening web is held in a gap between the holding rail and the adjacent floor, wall, or ceiling.

12. The drywall according to claim 11, wherein the drywall has a second sealing device comprising a second one-piece sealing profile comprising a second bearing web which is opposite the circumferential side of the cladding, a second fastening web running parallel to the second bearing web that fastens the second sealing profile to the holding rail of the drywall, and a second outer supporting web, viewed in cross section, covering the edge joint at least in portions, wherein the second outer supporting web is adjacent to and supports the second bearing web and via which the second bearing web is connected to the second fastening web, wherein the cladding is double-layer cladding with a first cladding part and a second cladding part, the first cladding part pressing with a circumferential side against the bearing web of the first sealing profile and the second cladding part pressing with a circumferential side against the second bearing web of the second sealing profile, and wherein the second fastening web of the second sealing profile is arranged in a gap between the first sealing profile and the adjacent floor, wall, or ceiling.

13. The drywall according to claim 11, wherein the sealing profile of the sealing device has a connecting web via which the fastening web is connected to the outer supporting web, wherein the connecting web, viewed in cross section, extends obliquely away from the fastening web from a plane formed by the fastening web up to the outer supporting web, wherein a sealing strip is arranged on an outside of the connecting web in order to close a gap between the plane and the connecting web, wherein, between the floor, wall, or ceiling and the fastening web which is opposite and inclined, the sealing strip is arranged on the outside of the connecting web in order to close a gap between the floor, wall, or ceiling and the fastening web.

14. A method for producing drywall having a holding rail, cladding, and a sealing device according to claim 1, the method comprising:

attaching the holding rail to the floor, wall, and/or, ceiling, driving the fastening web into a gap between the holding rail and the adjacent floor, wall, or ceiling, so that the fastening web is clamped between the holding rail and the adjacent floor, wall, or ceiling, and fastening the cladding to a stand construction of the drywall, wherein the cladding rests with the circumferential side against the bearing web.

* * * * *